US006831402B2

(12) United States Patent
Kamiguchi

(10) Patent No.: US 6,831,402 B2
(45) Date of Patent: Dec. 14, 2004

(54) IMAGE DISPLAY APPARATUS HAVING VOLTAGE APPLICATION STRUCTURE

(75) Inventor: Kinya Kamiguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/207,221

(22) Filed: Jul. 30, 2002

(65) Prior Publication Data

US 2003/0025443 A1 Feb. 6, 2003

(30) Foreign Application Priority Data

Jul. 31, 2001 (JP) ..... 2001-231642
Jul. 17, 2002 (JP) ..... 2002-208139

(51) Int. Cl.[7] ..... H01J 1/62

(52) U.S. Cl. ..... 313/495; 313/496; 313/497; 313/309; 313/310; 313/311; 313/336; 313/583; 313/351; 313/493; 313/483

(58) Field of Search ..... 313/495–497, 313/309–311, 336, 583, 483, 351, 493

(56) References Cited

U.S. PATENT DOCUMENTS 5,747,927 A * 5/1998 Namikawa et al. ..... 313/495
5,770,918 A * 6/1998 Kawate et al. ..... 313/495
6,104,135 A * 8/2000 Stansbury ..... 313/495
6,114,804 A * 9/2000 Kawase et al. ..... 313/495
6,407,500 B1 * 6/2002 Tsuburaya et al. ..... 313/495
6,528,939 B1 * 3/2003 Kawase ..... 313/495
6,603,255 B2 * 8/2003 Takahashi ..... 313/496
2003/0137235 A1 * 7/2003 Yamanobe et al. ..... 313/495
2003/0141796 A1 * 7/2003 Kamiguchi ..... 313/281

FOREIGN PATENT DOCUMENTS

| | | |
|---|---|---|
| EP | 0865069 | 9/1998 |
| JP | 5-114372 | 5/1993 |
| JP | 10-321167 | 12/1998 |
| JP | 2000-195449 | 7/2000 |

* cited by examiner

*Primary Examiner*—Ashok Patel
*Assistant Examiner*—Holly Harper
(74) *Attorney, Agent, or Firm*—Fitzpatrick, Cella, Harper & Scinto

(57) ABSTRACT

To provide a voltage application structure that is electrically stable and a display apparatus using the voltage application structure, while reducing the size, thickness, and cost of the display apparatus. A through hole structure is formed in the vicinity of a cylindrical hole established in a rear plate in advance. The through hole structure is electrically connected to lead wiring led to the outside from an anode electrode through a conductive elastic structure. A voltage to the anode electrode is applied to the through hole structure on the atmosphere side, and thus the voltage is applied to the anode electrode through the vacuum side of the through hole structure, the elastic structure, and the lead wiring. Vacuum hermeticity is maintained by filling the hole of the through hole structure with frit. Also, low-voltage wiring that is connected to the ground and regulates a potential is arranged around the through hole structure.

11 Claims, 11 Drawing Sheets

VOLTAGE APPLICATION STRUCTURE
117

VOLTAGE APPLICATION STRUCTURE
117

IMAGE DISPLAY APPARATUS HAVING VOLTAGE APPLICATION STRUCTURE

BACKGROUND OF THE INVENTION

1. Field of the Invention

The present invention relates to a voltage application structure used for a display of a television receiver, a computer, or the like, a message board that displays characters or images, or the like. The present invention also relates to a display apparatus using this voltage application structure.

2. Related Background Art

In recent years, there have widely been used color cathode-ray tubes (CRTs) as display apparatuses. The driving principle of these CRTs is a method with which electron beams from cathodes are deflected to have phosphors of screens emit light. This means that the display apparatuses are required to have depths corresponding to their screen sizes.

However, in the case where the depths of the display apparatuses are increased, there occur problems such as enlarged installation spaces and increased weights thereof, which has led to a strong and earnest desire to realize a flat type display apparatus whose thickness and weight are reduced.

As examples of the flat type display apparatus and a method of supplying power of a high voltage to the apparatus, there is disclosed a surface conduction electron-emitting type display panel (hereinafter referred to as the "SED") in JP 10-321167 A and JP 2000-195449 A and there is also disclosed a field emission type display apparatus (hereinafter referred to as the "FED") in JP 05-114372 A.

In FIG. 10, there is shown the outline of the FED disclosed in JP 05-114372 A as a conventional flat type display apparatus.

We have found, as a result of earnest studies, a problem that it is difficult to perform the control of an area to which an anode potential is applied, in the case where a potential is supplied to an anode electrode through an elastic body like in JP 2000-195449 A and JP 05-114372 A described above. This point will be described in detail below. In the case where a potential is supplied to an anode electrode through an elastic body in the manner described above, each panel has a different distance between a rear plate and a face plate or the elastic characteristic of an elastic body is degraded as a result of a process like seal bonding that is performed at high temperature. As a result, there is a case where each panel has a different shrinking state of the elastic body or a different length of elapsed time results in a different shrinking state. In such a case, there is varied an area within a panel in which the elastic body exists, which results in a situation where there is changed an application area in which an anode potential is applied to the elastic body. This changing of the application area of the anode potential causes various problems such as (1) changing of the trajectory of an electron beam emitted from an electron-emitting device in the vicinity of the anode potential application area and (2) induction of accidental discharging within a panel.

We also have found that a high-voltage terminal for supplying a potential to an anode electrode of an anode substrate is led to the outside using an opening established in a cathode substrate, so that a potential on a surface (surface of the cathode substrate exposed to the air) on a side opposite to a surface forming a vacuum container of the cathode substrate becomes unstable and this may bring about accidental discharging or the like. This point will be described in detail below. In the case where a high-voltage terminal for supplying a potential to an anode electrode of an anode substrate is led to the outside through an opening established in a cathode substrate in the manner described above, the periphery of the opening on a surface of the cathode substrate on the atmosphere side is covered with the potential of the high-voltage terminal, so that the periphery is regulated to have a potential that is approximately the same as that of the high-voltage terminal. The atmosphere on the periphery of the opening on the surface of the cathode substrate on the atmosphere side is the air, so that there is a fear that discharging occurs under such a state where a high voltage is applied. In particular, in the case of a flat panel display, a drive circuit of a display apparatus, a vacuum container holding structure that connects a vacuum container to an enclosure, and the like are arranged adjacent to each other around the surface on a side opposite to the vacuum container forming surface of a cathode substrate, so that there is a fear that accidental discharging is induced between the high-voltage terminal and another member.

Also, there is another problem described below in the case of a structure shown in FIG. 10 described above.

The vacuum sealing of a seal body 18 requires the vacuum sealing at an interface between a terminal leading portion 17 and the seal body 18 and the vacuum sealing between the seal body 18 and a rear panel 3. As a result, there is an increased possibility of leakage because a plurality of sealed portions exist, which makes it impossible to obtain a voltage application structure with high hermetic reliability.

Also, the terminal leading portion 17 protrudes to the outside, which becomes a great hindrance to the reduction in the size and thickness of an ultra thin flat panel display apparatus 20.

Further, during a process of producing the ultra thin flat panel display apparatus 20, in order to cope with the protrusion of the terminal leading portion 17 to the outside, it is required to secure a space for a production apparatus and an inspection apparatus. As a result, the process of producing the display apparatus becomes complicated and the costs rise.

In view of the problems described above, an object of the present invention is therefore to suppress the induction of accidental discharging by controlling an area to which a high voltage is applied, to reduce the size, thickness, and costs of a display apparatus, and to provide a display apparatus where a potential is stabilized.

SUMMARY OF THE INVENTION

In order to achieve the above-mentioned object, according to the present invention, there is provided a display apparatus comprising at least: a vacuum container that includes at least a first substrate and a second substrate, the first substrate having on the same surface an electron source and a first conductor that is regulated to have a higher potential than the electron source, and the second substrate having on a surface thereof an image forming member that has a second conductor regulated to have approximately the same potential as the first conductor, with the surface having the image forming member being arranged so as to oppose the surface of the first substrate having the electron source; and a conductive elastic structure made at least partially of an elastic body, which exists inside of the vacuum container and contacts the first conductor and the second conductor so as to electrically connect the first conductor to the second conductor, the display apparatus being characterized in that conductive elastic structure is contained within an area in which an orthographic projection area of the first conductor to the second substrate overlaps an orthographic projection area of the second conductor to the first substrate.

Also, preferably, the display apparatus is characterized in that the first substrate has a through hole terminal connected to the inside of the vacuum container and the potential of the first conductor is regulated through the through hole terminal.

Also the display apparatus is characterized in that the first substrate has low-voltage wiring that is arranged around the first conductor and is regulated to have a lower potential than the first conductor.

Also, the display apparatus is characterized in that a high-resistance film is provided between the first conductor and the low-voltage wiring.

Also, the display apparatus is characterized in that each of the first conductor and the conductive elastic structure is axially symmetrical about a center axis, and the respective center axes of the first conductor and the conductive elastic structure substantially coincide with each other.

Also, the display apparatus is characterized in that means for sealing the vacuum container also serves as means for positioning the conductive elastic structure.

Also, the display apparatus is characterized in that the conductive elastic structure has an elastic portion including a plurality of springs whose number is at least equal to three.

Also, according to another aspect of the present invention, there is provided a display apparatus comprising at least: a vacuum container that includes at least a first substrate having an electron source on a surface thereof and a second substrate having on a surface thereof an image forming member arranged such that the surface having the image forming member opposes the surface of the first substrate having the electron source, the image forming member having an anode electrode that is regulated to have a higher potential than the electron source; and a conductive member that exists inside of the vacuum container, is electrically connected to the anode electrode, and is led to the outside of the vacuum container through a hole established in the first substrate, the display apparatus being characterized in that a conductive layer is provided around the hole on a surface of the first substrate on a side opposite to the inner surface of the vacuum container; and the conductive layer is regulated to have a lower potential than the anode electrode.

Also, preferably, the display apparatus is characterized by comprising a circuit for driving the display apparatus in the vicinity of the first substrate at the outside of the vacuum container.

Also, the display apparatus is characterized by further comprising a voltage withstand structure between the conductive member and the conductive layer.

Also, the display apparatus is characterized in that the voltage withstand structure is constructed from an insulating material.

Also, the display apparatus is characterized in that the voltage withstand structure is constructed from a high-resistance film.

DESCRIPTION OF THE PREFERRED EMBODIMENTS

Operation

In the present invention constructed in the manner described above, a conductive elastic structure for supplying power to an anode electrode is contained within an area in which the orthographic projection of a conductor (first conductor) provided on a vacuum surface of a rear plate to a face plate overlaps the orthographic projection of a conductor (second conductor), such as an anode electrode or a lead electrode portion for supplying power to the anode electrode, to the rear plate. With this structure, the potential distribution on the periphery of the elastic structure body does not depend on the shape of the elastic structure body but is regulated by the first conductor and the second conductor. This makes it possible to prevent accidental discharging due to the shape (projection etc.) of the elastic structure body or positional relations.

Also, by applying a low potential, such as the ground, to a conductive layer provided on an atmosphere side of the rear plate, even in a structure where a conductive member provided for anode power supply is led to the outside through a hole provided in the rear plate, it becomes possible to confine an area, in which there exists a high potential applied to the conductive member for anode power supply, within the inside of a low-voltage layer (conductive layer) (area between the low-voltage layer (conductive layer) and the conductive member for anode power supply). As a result, it becomes possible to prevent accidental discharging on the periphery of the atmosphere side of the rear plate.

Embodiment Mode

An embodiment mode of the present invention will be described below with reference to the drawings.

Figure 4:
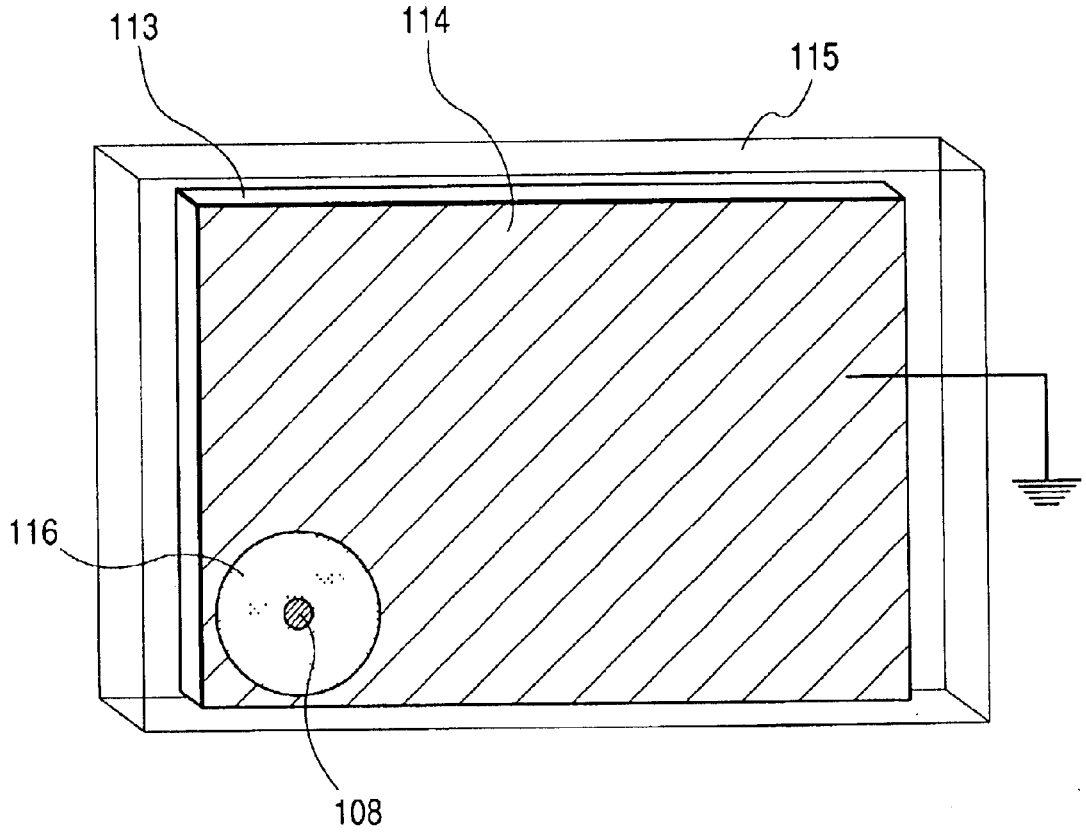
FIG. 4 is an outline diagram showing an example of the construction of the voltage application structure of the present invention and an SED that adopts the display apparatus using this voltage application structure.

A disassembled perspective view and an assembled sectional view of an example of a voltage application structure of the present invention and a display apparatus using this voltage application structure are shown in FIGS. 1A to 1C and 2, respectively. Also, FIG. 4 shows the outline of the voltage application structure and the display apparatus using this voltage application structure shown in FIGS. 1A to 1C and 2. Note that FIG. 4 is a drawing viewed from a side (atmosphere side of the rear plate) opposite to a display portion (not shown) of the display apparatus.

When a display panel 113 of the present invention is produced, first, a face plate 101, on whose surface image forming member comprising an anode electrode 106 and phosphor is placed, and a rear plate 102, on whose surface an electron source area 105 is placed, are placed so as to oppose each other and these plates are seal-bonded with frit 104*b* through a frame 103. Following this, the internal air between the face plate 101 and the rear plate 102 is suck out through an exhaust pipe (not shown), these plates are sealed, and a vacuum structure is formed. In this manner, the display apparatus 113 is produced. Note that the face plate 101, the rear plate 102, and the frame 103 are made of glass or the like.

Figure 10:
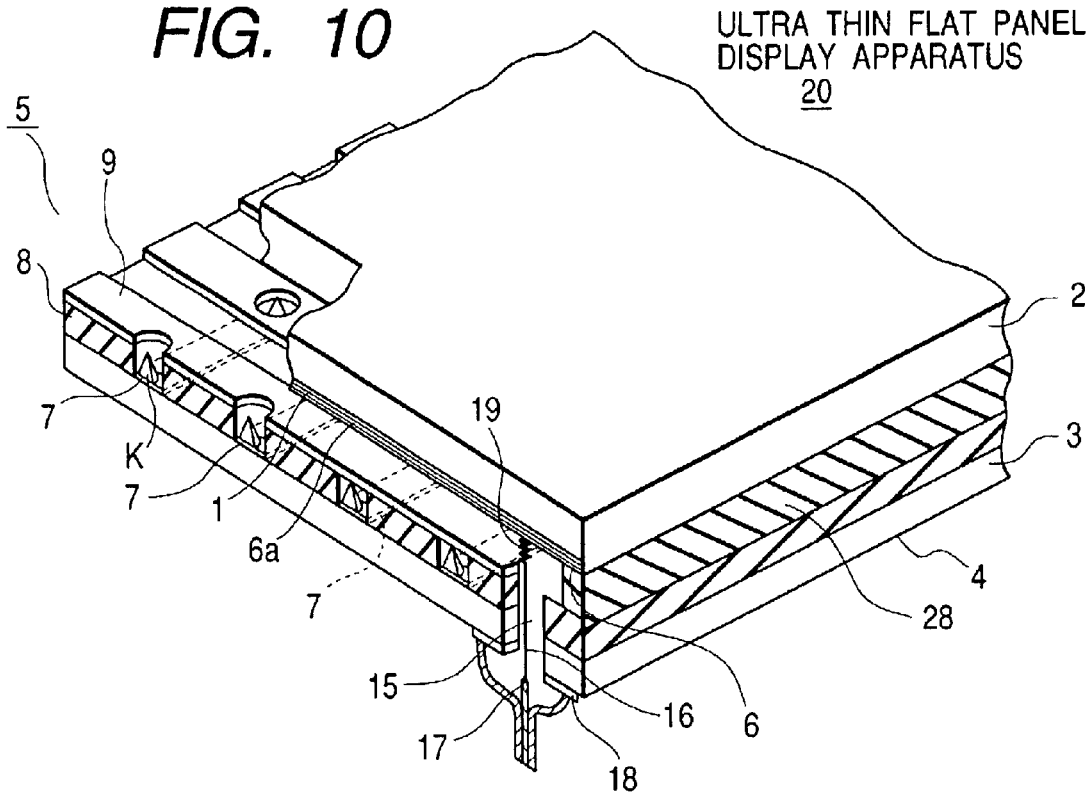
FIG. 10 is an outline diagram showing an anode leading portion of a conventional display apparatus.

A voltage application structure 117 is a structure for applying a voltage to the anode electrode 106 in a vacuum from the air. In this embodiment, as a preferable form, the voltage application structure 117 is constructed from lead wiring (second conductor) 100 in a vacuum, an elastic structure 107, a voltage withstand member (high resistance film) 109, low-voltage wiring 110, a through hole structure 108 for establishing conduction from the vacuum to the air, and a potential regulating structure on the atmosphere side. Note that the lead wiring 100 and the anode electrode 106 are described using different names, although the lead wiring 100 is a name given to a part of the anode and the second conductor is constructed from the anode electrode 106 and the lead wiring 100. In addition, here, the through hole structure means a structure constructed from a passing-through hole established in the rear plate, a through hole terminal that is directly electrically connected to the anode electrode (second conductor) through the passing-through hole or is electrically connected to the anode electrode through another conductor, an electrode (first conductor: 118*a*) provided on the vacuum side of the rear plate that is electrically connected to this through hole terminal, and an electrode (118*c*) provided on the atmosphere side of the rear plate. Also, the potential regulating structure is constructed from a voltage withstand structure 116 and a low-voltage layer 114. Note that in the following description, a structure, out of voltage application structures, where the same potential is applied to the anode electrode, is called a high-voltage application structure (conductive member) in some cases. In the form described above, the high-voltage application structure is constructed from the elastic structure and the through hole structure. Note that the high-voltage application structure (conductive member) is not limited to the structure described above. For instance, it is also possible to use a pin-shaped structure (for instance, a potential supplying terminal 16 in FIG. 10) or the like in the case where there is included a through hole structure or a potential regulating structure of a type where an opening is completely filled with a conductor.

In this embodiment mode described above, a voltage applied to the through hole structure 108 of the rear plate 102 is applied to the anode electrode 106 through a vacuum side electrode (first conductor) of the through hole structure 108, the elastic structure 107, and the lead wiring 100.

The through hole structure 108, the elastic structure 107, and the potential regulating structure will be described in detail below.

(1) Through Hole Structure

The through hole structure 108 is provided in a passing-through hole having a cylindrical shape established in the rear plate 102 using a drill or the like in advance, and is constructed from an electrode constructed from the first conductor formed on the vacuum inner surface of the rear plate 102, an electrode formed on the atmosphere side, and an electrode (through hole terminal) formed on the inner surface of the passing-through hole for establishing electrical conduction between these electrodes. Note that the through hole structure 108 is constructed so as to be axially symmetrical about a center axis.

A method of producing the through hole structure 108 will be described with reference to FIGS. 5A to 5C.

Figure 5A:
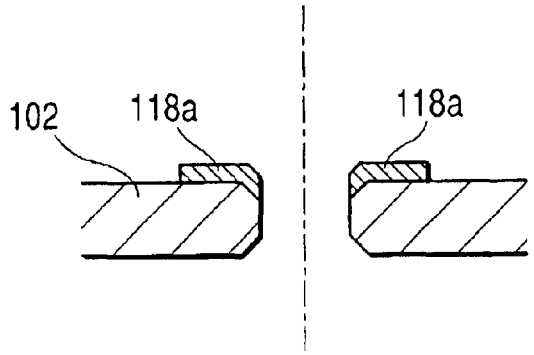
FIGS. 5A, 5B and 5C illustrate a process of producing a through hole structure used for the voltage application structure of the present invention.
Figure 5B:
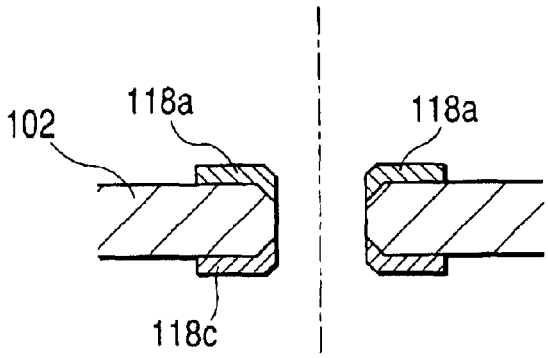
Figure 5C:
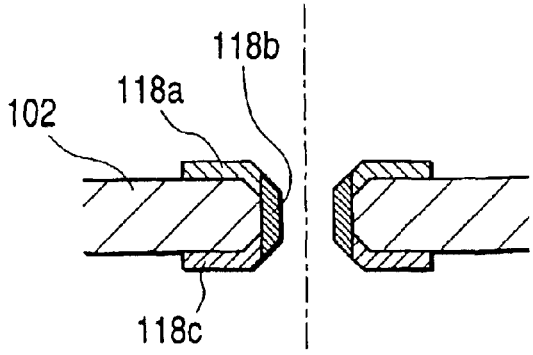

First, the electron source area 105 and the wiring 118*a* (first conductor) are formed on the rear plate 102 at the same time (FIG. 5A). Next, the wiring 118*c* is formed on the rear plate 102 on the opposite side, with the rear plate 102 being sandwiched between the wiring 118*a* and the wiring 118*c* (FIG. 5B). Next, the wiring 118*b* (through hole terminal electrode) is formed on the hole wall surface between the wiring 118*a* and the wiring 118*c* (FIG. 5C). Following this, by performing drying and baking, there is produced the through hole structure 108 where the wirings 118*a*, 118*b*, and 118*c* are integrated with each other. Also, vacuum hermeticity is maintained by filling the hole of the through hole structure 108 with the frit 104*a*.

(2) Elastic Structure

The elastic structure 107 is placed between the through hole structure 108 on the rear plate 102 and the face plate 101. Note that the elastic structure 107 is constructed so as to be substantially axially symmetrical about a center axis and the center axis of the elastic structure 107 substantially coincides with the center axis of the through hole structure 108. Also, on the face plate 101, there is provided the lead wiring 100 (second conductor) from the anode electrode 106 described above to a portion contacting the elastic structure 107. Here, the elastic structure 107 is arranged so as to be contained within an area in which the orthographic projection area of the first conductor described above to the face plate overlaps the orthographic projection area of the second conductor to the rear plate. With this structure, an area, in which an anode potential is applied, is regulated without being affected by an expanding and contracting state of the elastic structure. As a result, it becomes possible to prevent the changing of the trajectory of an electron beam emitted from an electron-emitting device in the vicinity of the high-voltage power supply structure and accidental discharging within a panel. Note that it does not matter whether the elastic structure 107 is placed with a method with which the elastic structure 107 is placed on the rear plate 101 when the rear plate 102 and the face plate 101 are seal-bonded or with a method with which the elastic structure 107 is fixed with the frit 104*a* when the through hole structure 108 is produced.

As to a material of the elastic structure 107, there occurs no problem so long as the material has conductivity. For instance, it is possible to use a metal, carbon, or the like. Note that during the selection of the material of the elastic structure 107, it is preferable that a material is selected which has a coefficient of thermal expansion that is the same as that of the rear plate 102. For instance, there may be selected the 426 alloy, the 48 Ni alloy, or the like.

As to the structure of the elastic structure 107, it is enough that at least a part thereof has elasticity. For instance, there may be used a plate spring structure, a conical spring structure, a helical spring structure, or the like, as the structure of the elastic portion. Further, positioning members (members 212, 312, 412, and the like to be described later) may be used to place the elastic structure 107. It is preferable that there are used members having conductivity as the materials of these positioning members. In particular, a metal or carbon is a further preferable material. Note that in the case where a metal is used as a material of the elastic structure 107, the rear plate 102 is made of glass, so that it is preferable that there is selected a material having the same coefficient of thermal expansion. For instance, there may be selected the 426 alloy, the 48 Ni alloy, or the like.

Also, a more preferable form on the periphery of the first conductor will be described below.

It is preferable that a circular low-voltage wiring 110 is formed on the rear plate 102 on the periphery of the vacuum side (first conductor) of the through hole structure 108 so as to maintain a certain distance from the vacuum side of the through hole structure 108 during the production of the electron source area 105. The low-voltage wiring 110 is regulated to have a ground potential at an end of the rear plate 102 by a lead wiring of lower voltage 111 that is electrically connected to the ground on the enclosure 115 side. By arranging the low-voltage wiring 110 around the through hole structure 108, to which a voltage is applied, in this manner, it becomes possible to confine an existing area of a high potential applied to the through hole structure within the inside of the low-voltage wiring (area between the low-voltage wiring and the through hole), which makes it possible to prevent accident discharge from occurring on the periphery of the through hole structure. As a result, it becomes possible to suppress the changing of an electric field around the through hole structure 108 and therefore to obtain a voltage application structure in which a potential is stabilized. As a result, it becomes possible to drive the display apparatus 113 with stability.

Further, it is more preferable that a voltage withstand member 109 is formed on the rear plate 102 between the through hole structure 108 (first conductor) on the vacuum side and the low-voltage wiring 110. A high-resistance film is formed for the voltage withstand member 109. In this case, a potential is further stabilized and the withstand voltage is improved with this film. As to this film, it is preferable that there is used a film having a resistance value exhibiting an optimum withstand voltage in accordance with the distance between the through hole structure 108 on the vacuum side and the low-voltage wiring 110 and their shapes. For instance, the film is an antistatic film or the like. With this construction, a minute amount current flows between the first conductor and the low-voltage wiring, thereby making it possible to confine a potential, between the first conductor and the low-voltage wiring, within the inside of the low-voltage wiring while distributing the potential at substantially regular intervals. As a result, it becomes possible to prevent discharging with more reliability.

(3) Potential Regulating Structure

The low-voltage layer (conductive layer) 114 is a circular layer formed on the rear plate 102 so that a certain distance is maintained from the atmosphere side of the through hole structure 108. The low-voltage layer (conductive layer) 114 is, for instance, electrically connected to the ground on the enclosure 115 side and is regulated to have the ground potential. With this structure, it becomes possible to confine the existing area of the high potential applied to the through hole structure within the inside of the low-voltage layer (conductive layer) (area between the low-voltage layer (conductive layer) and the through hole), which makes it possible to prevent accidental discharging on the periphery of the rear plate atmosphere side.

The voltage withstand structure 116 is formed between the through hole structure 108 and the low-voltage layer (conductive layer) 114. The voltage withstand structure 116 is constructed from an insulating member coated with an insulating material having high volume resistivity or a high-resistance film. For instance, the insulating member is an antistatic film, potting using an insulating material, or the like. Note that the center axis of the voltage withstand structure 116 substantially coincides with the center axes of the elastic structure 107 and the through hole structure 108.

The potential regulating structure is a structure where the low-voltage layer 114 (conductive layer) is arranged around the through hole structure 108 to which a voltage is applied, or preferably the voltage withstand structure 116 is placed between the through hole structure 108 and the low-voltage layer (conductive layer) 114. With this structure, it becomes possible to confine the existing area of the high potential within the inside of the low-voltage layer with more reliability and to suppress the changing of the electric field around the through hole structure 108 with more reliability. By adopting a potential regulating structure like this, it becomes possible to apply a voltage with stability and to drive the display panel 113 with stability.

Figure 11:
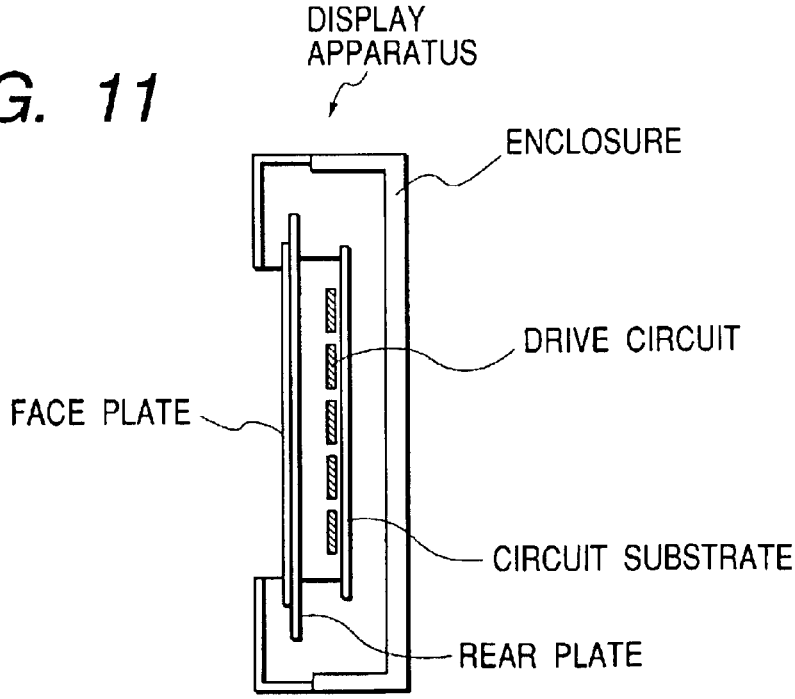
FIG. 11 is a sectional view of a display apparatus of the present invention.

Also, the display apparatus is produced by sealing the display panel 113, an unillustrated voltage power supply, a voltage cable, a drive circuit substrate, a low-voltage power supply, and the like in the enclosure 115 (FIG. 11).

An embodiment mode of the present invention has been described above. Here, the positional relations among the first conductor, the second conductor, and the elastic structure that are the features of the present invention will be described with reference to FIGS. 1B and 1C. FIG. 1B is a front view on the vicinity of the voltage application structure on the rear plate viewed from the face plate side, while FIG. 1C is a front view of the voltage application structure on the face plate viewed from the rear plate side. In the present invention, as shown in FIGS. 1B and 1C, the elastic structure 107 is positioned inside of the first conductor and the second conductor. In other words, the elastic structure body is contained between the orthographic projection area of the first conductor to the face plate and the orthographic projection area of the second conductor to the rear plate. With this structure, the potential distribution in the vicinity of the elastic structure 107 changes from the potential distribution caused by the potential difference between the elastic structure 107 and the low-voltage wiring 110 to the potential distribution caused by the potential difference between the first conductor and the low-voltage wiring 110, which makes it possible to suppress the occurrence of discharge due to the protruding portion resulting from the shape of the elastic structure 107, the roughness of finishing, or the like. Also, the low-voltage layer (conductive layer) is provided on a surface (underside) on a side opposite to the electron source forming surface of the rear plate, so that it becomes possible to confine the existing area of the high potential within the inside of the conductive layer (low-voltage layer) even if the high-voltage application structure (conductive member) having the same potential as the anode electrode exists on the underside of the rear plate. As a result, it becomes possible to prevent accidental discharge from occurring on the periphery of the underside of the rear plate. In particular, in the case of a flat panel display, as shown in FIG. 11, a circuit substrate and the like are arranged adjacent to the underside of the rear plate, so that there is a fear that accidental discharge occurs. However, by using the structure of the present invention, it becomes possible to circumvent the occurrence of discharging, which means that it is particularly preferable that the present invention is applied to a flat panel display.

Further, in the embodiment mode described above, it is preferable that the elastic structure 107 that is substantially axially symmetrical, the through hole structure 108 formed on the rear plate 102, and the voltage withstand structure 116 on the atmosphere side are adopted for the voltage application structure 117 to the anode electrode 106 and their center axes are set so as to substantially coincide with each other. With the construction like this, the potential distribution from the center axis of the voltage application structure 117 also becomes substantially axially symmetrical, so that it becomes possible to further reduce the distortion of a potential that becomes a cause of discharging. As a result, it becomes possible to obtain the voltage application structure 117 and the display panel 113 in which a potential is stabilized. Also, by using the through hole structure in the manner described above, it becomes possible to seal a vacuum structure only by sealing the passing-through hole of the through hole structure 108, so that it becomes possible to reduce the number of sealed portions. As a result, it becomes possible to improve the hermetic reliability of the voltage application structure 117. Also, the vacuum sealing is performed within the passing-through hole of the through hole 108, so that it becomes possible to eliminate a protrusion from the back of the display panel 113.

Embodiments of the present invention will be described below, although there is no intention to limit the present invention to these embodiments.

Embodiments (First Embodiment)

Figure 1A:
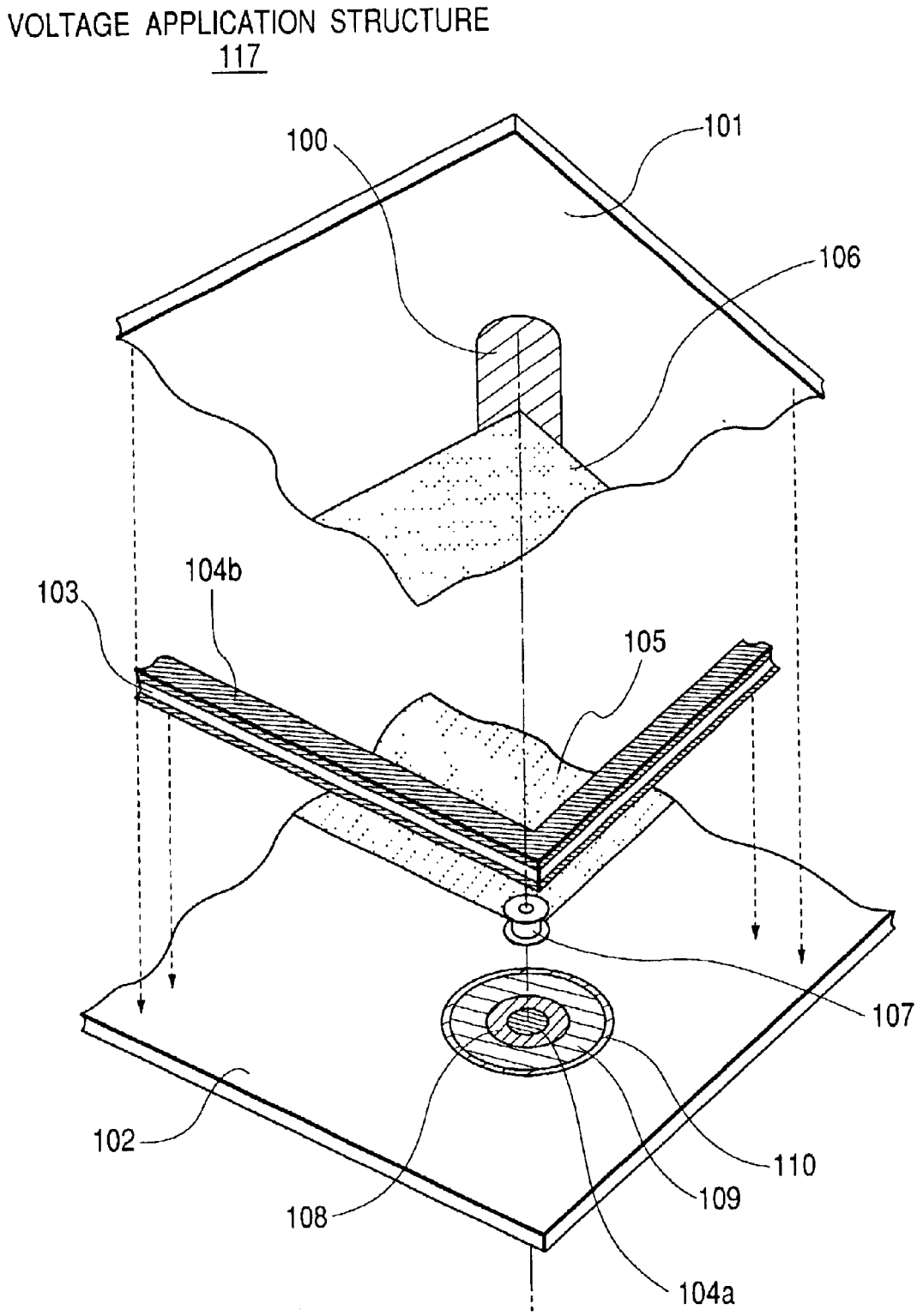
FIG. 1A is a disassembled perspective view showing a voltage application structure of the present invention and a first embodiment of a display apparatus using this voltage application structure.
Figure 1B:
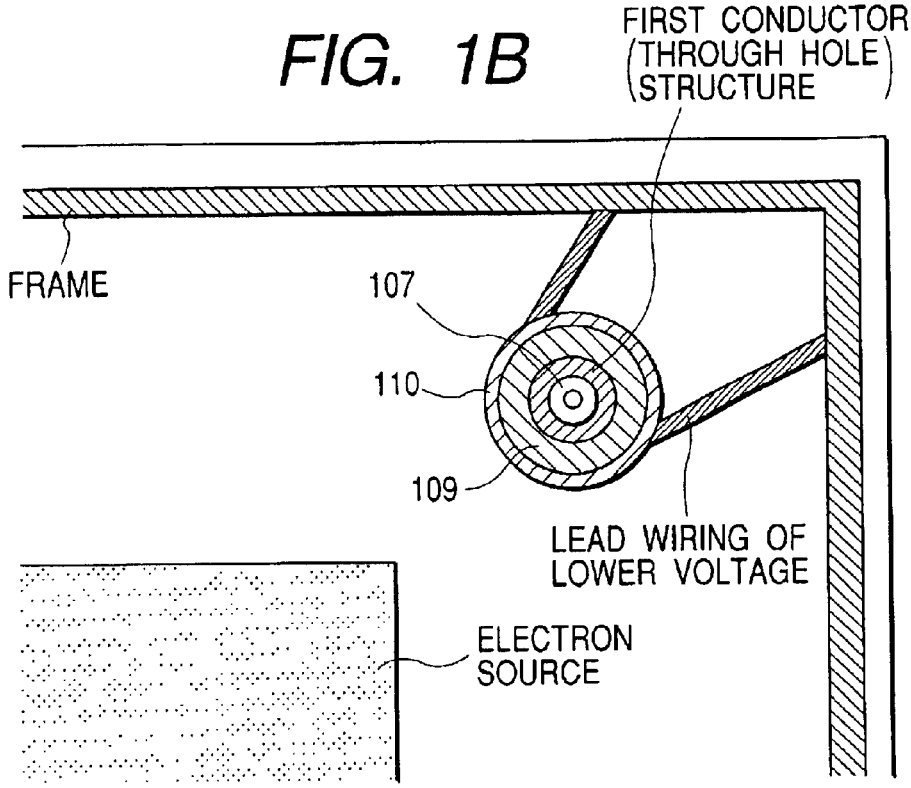
FIG. 1B is a partial plain view of the voltage application structure of the present invention and a rear plate of the display apparatus using this voltage application structure.
Figure 1C:
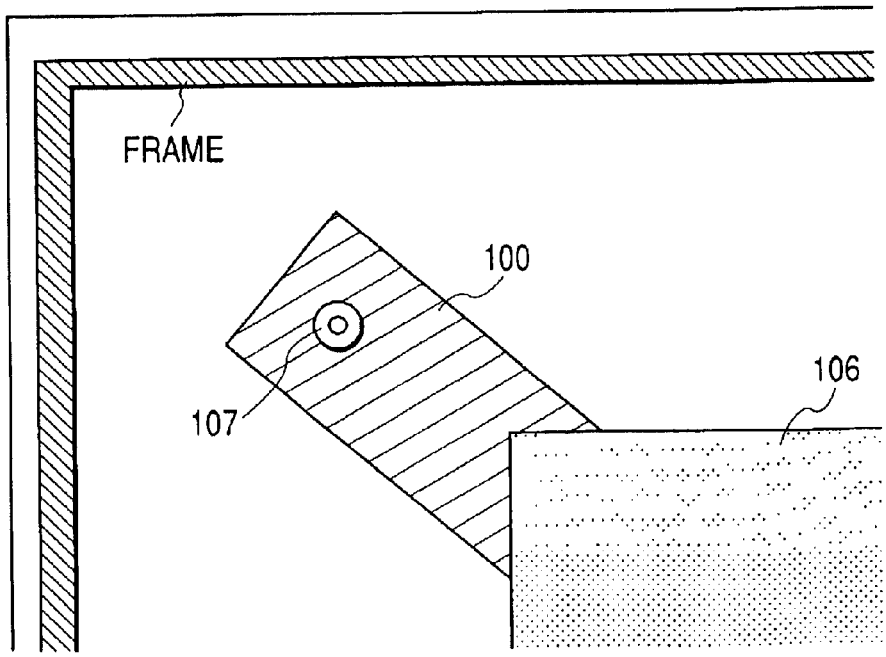
FIG. 1C is a partial plain view of the voltage application structure of the present invention and a face plate of the display apparatus using this voltage application structure.
Figure 2:
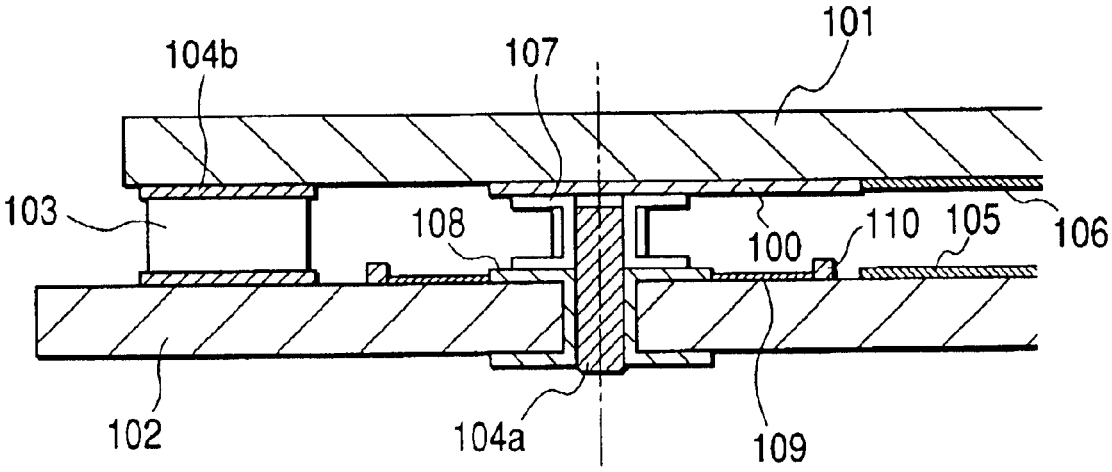
FIG. 2 is an assembled sectional view showing the voltage application structure of the present invention and the first embodiment of the display apparatus using this voltage application structure.

FIGS. 1A to 1C are each a disassembled perspective view of a first embodiment of the voltage application structure 117 of the present invention and a display apparatus using this voltage application structure. Also, FIG. 2 is an assembled sectional view of the first embodiment of the voltage application structure of the present invention and the display apparatus using this voltage application structure. Further, FIG. 4 shows the outline of the voltage application structure and the display apparatus using this voltage application structure shown in FIGS. 1A to 1C and 2. Note that FIG. 4 is a drawing viewed from a side (atmosphere side of the rear plate) opposite to a display portion (not shown) of the display apparatus (the enclosure is omitted in part for ease of explanation and there is shown the rear plate atmosphere side of the display panel).

When the display panel 113 of this embodiment is to be produced, first, a face plate 101, on whose surface an anode electrode 106 is placed, and a rear plate 102, on whose surface an electron source area 105 is placed, are placed so as to oppose each other and these plates are seal-bonded with the frit 104*b* through the frame 103. Following this, the internal air between the face plate 101 and the rear plate 102 is suck out through an exhaust pipe (not shown), these plates are sealed, and a vacuum structure is formed, thereby producing the display panel 113. Note that the face plate 101, the rear plate 102, and the frame 103 are made of glass.

A voltage application structure 117 is a structure for applying a voltage to the anode electrode 106 in a vacuum from the air, and is constructed from a lead wiring 100 in a vacuum, an elastic structure 107, a voltage withstand member 109, low-voltage wirings 110, a through hole structure 108 for establishing conduction from the vacuum to the air, and a potential regulating structure on the atmosphere side. The potential regulating structure is constructed from a voltage withstand structure 116 and a low-voltage layer 114.

In this embodiment, the voltage applied to the through hole structure 108 on the atmosphere side of the rear plate 102 is applied to the anode electrode 106 through the vacuum side of the through hole structure 108, the elastic structure 107, and the lead wiring 100.

The through hole structure 108, the elastic structure 107, and the potential regulating structure will be described in detail below.

(1) Through Hole Structure

The through hole structure 108 is provided in a passing-through hole (whose diameter is around 2 mm) having a cylindrical shape established in the rear plate 102 (whose thickness is around 2.8 mm) using a drill or the like in advance, and is constructed from electrodes (whose thickness is around 20 $\mu$m) formed on the surface and the underside (vacuum inner surface and the vacuum structure external surface) of the rear plate 102 and an electrode (whose thickness is around 20 $\mu$m) formed on the inner surface of the passing-through hole for establishing electrical conduction among these electrodes. Note that the through hole structure 108 is constructed so as to be axially symmetrical about a center axis.

A method of producing the through hole structure 108 will be described with reference to FIGS. 5A to 5C.

First, the electron source area 105 is formed on the rear plate 102. At the same time, the wiring 118*a* is formed thereon by baking a silver paste (NP-4045 manufactured by Noritake Co.,Limited) at 420 degrees centigrade (FIG. 5A) . Next, the wiring 118*c* is formed by transferring a silver paste by squeegee printing onto the rear plate 102 onto the counter-electrode side, with the rear plate 102 being sandwiched between the wiring 118*a* and the wiring 118*c* (FIG. 5B). Next, the wiring 118*b* is formed by evenly applying a silver paste on the hole wall surface between the wiring 118*a* and the wiring 118*c* using a metallic rod (FIG. 5C). Following this, by performing drying at 120 degrees centigrade and baking at 420 degrees centigrade, there is produced the through hole structure 108 where the wirings 118*a*, 118*b*, and 118*c* are integrated with each other. Also, vacuum hermeticity is maintained by injecting the frit 104*a* into the center hole of the through hole structure 108, performing drying at 120 degrees centigrade, and performing baking at 390 degrees centigrade.

Also, on the vacuum side of the through hole structure 108, a circular low-voltage wiring 110 is formed on the rear plate 102 so that a certain distance of 4 [mm] is maintained from the vacuum side of the through hole structure 108 during the production of the electron source area 105. The low-voltage wiring 110 is regulated to have a ground potential at an end of the rear plate 102 by a lead wiring of lower voltage 111 that is electrically connected to the ground on the enclosure 115 side. By arranging this low-voltage wiring 110 around the through hole structure 108 to which a voltage is applied, it becomes possible to suppress the changing of an electric field around the through hole structure 108 due to environmental variations and therefore to obtain a voltage application structure in which a potential is stabilized. As a result, it becomes possible to drive the display apparatus 113 with stability.

Further, the voltage withstand member 109 is formed on the rear plate 102 between the through hole structure 108 on the vacuum side and the low-voltage wiring 110. A high-resistance film (sheet resistance value=around 1.0E+12[Ω]) is formed for this voltage withstand member 109. A potential is further stabilized and a withstand voltage is improved with this film. As to the resistance value of this film, it is preferable that there is used a film having a resistance value exhibiting an optimal withstand voltage in accordance with the distance between the through hole structure 108 on the vacuum side and the low-voltage wiring 110 and their shapes. In this embodiment, there is used an antistatic film disclosed in JP 08-180801 A.

(2) Elastic Structure

The elastic structure 107 is placed between the through hole structure 108 on the rear plate 102 and the face plate 101. Note that the elastic structure 107 is constructed so as to be substantially axially symmetrical about a center axis and the center axis of the elastic structure 107 substantially coincides with the center axis of the through hole structure 108. Also, on the face plate 101, there is provided the lead wiring 100 from the anode electrode 106 described above to a portion contacting the elastic structure 107.

Figure 3A:
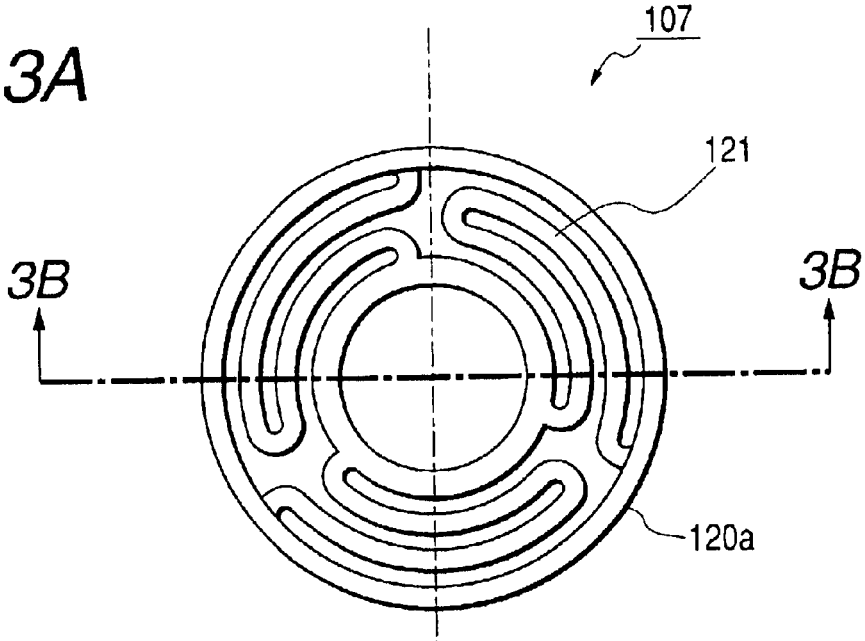
FIGS. 3A and 3B are outline diagrams showing an example of the construction of an elastic structure used for the voltage application structure of the present invention.
Figure 3B:
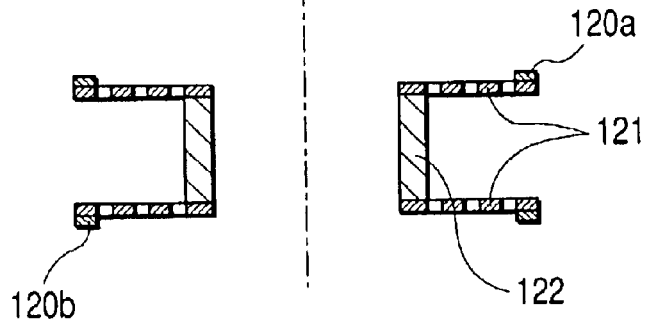

FIG. 3A is a plan view of the elastic structure 107 and FIG. 3B is a sectional view along the line 3B—3B of FIG. 3A. Note that the elastic structure 107 is placed so that the upper surface shown in FIG. 3A is directed toward the face plate 101.

Elastic portions 121 are grounded to the upper surface and the lower surface of a seating 122 by laser spot welding or the like, so that the center axes of the respective outline circles coincide with each other. Also, to circumferential edges of the surfaces of the elastic portions 121 that are not grounded to the seating 122, fulcrums 120*a* and 120*b* are grounded by laser spot welding or the like so that the center axes thereof coincide with each other in the like manner.

The elastic structure 107 is designed so that a surface of the fulcrum 120*a* that is not grounded to the elastic portion 121 is brought into intimate contact with the lead wiring 100 on the face plate 101 and a surface of the fulcrum 120*b* that is not grounded to the elastic portion 121 is brought into intimate contact with the through hole 108 on the rear plate 102. As a main material of the elastic structure 107, there is adopted the 48 Ni alloy.

The elastic structure 107 is placed on the vacuum side of the through hole structure 108 that is a surface of the rear plate 102 opposing the face plate 101, before the face plate 101 and the rear plate 102 are sealed.

As a method of placing the elastic structure 107, there is used a method with which in a step for sealing the passing-through hole (not shown) of the rear plate 102 with the frit 104*a*, the frit 104*a* is applied from a center hole of the elastic structure 107 positioned by the rear plate 102, the hole of the rear plate 102 and the center hole of the elastic structure 107 are filled with the frit 104*a*, drying is performed in a drying furnace (at 120 degrees centigrade for 10 minutes), and baking is performed in a baking furnace (at 390 degrees centigrade for 10 minutes).

Two plate spring structures are adopted for the elastic structure 107, with each plate spring structure being constructed from an elastic portion including three springs. The first plate spring structure has a structure where one of two fulcrums of a plate spring is fixed to a seating fixed to the rear plate 102 using the frit 104*a* and the other thereof is brought into press-contact with the through hole structure 108 of the rear plate 102. The second plate spring structure has a structure where one of two fulcrums of a plate spring is fixed to the seating fixed to the rear plate 102 by the frit 104*a* and the other of the two fulcrums of the plate spring is brought into press-contact with the lead wiring 100 of the face plate 101.

There is used the elastic structure 107 in order to establish electrical continuity between the lead wiring 100 on the face plate 101 side and the through hole structure 108 on the rear plate 102 side. With this construction, it becomes possible to prevent grounding failures resulting from minute deformations, a poor degree of parallelization, and the like occurring due to the thermal changing between the face plate 101 and the rear plate 102.

It is preferable that the elastic portion 121 is constructed from a plurality of springs whose number is at least equal to three. In this embodiment, three springs are arranged in parallel. With this construction, even in the case where a small protrusion or scratch exists on a surface contacting the fulcrums 120*a* and 120*b* of the face plate 101 and the rear plate 102, it becomes possible to have the fulcrums 120*a* and 120*b* contact the face plate 101 and the rear plate 102 with reliability.

An area occupied by the elastic structure 107 (whose diameter is around 5 mm) on the rear plate 101 is set as smaller than an area occupied by the electrode (first conductor: 118*a*) provided on the vacuum side of the rear plate constituting the through hole structure 108 (whose diameter is around 6 mm) and an area occupied by the lead wiring 100 (second conductor) of the face plate. With this structure, it becomes possible to place the elastic structure 107 so as not to lie off the lead wiring 100 on the face plate 101 side and the through hole structure 108 on the rear plate 102 side (the elastic structure 107 is contained within an area in which the orthographic projection area of the first conductor to the face plate overlaps the orthographic projection area of the second conductor to the rear plate). As a result, the potential distribution in the vicinity of the elastic structure 107 changes from the potential distribution caused by the potential difference between the elastic structure 107 and the low-voltage wiring 110 to the potential distribution caused by the potential distribution between the through hole structure 108 and the low-voltage wiring 110, which makes it possible to suppress an occurrence of discharging due to the protruding portion resulting from the shape of the elastic structure 107, the roughness of finishing, or the like. Also, it is possible to seal a vacuum structure only by sealing the passing-through hole of the through hole structure 108, so that it becomes possible to reduce the number of portions to be sealed. As a result, it becomes possible to improve the hermetic reliability of the voltage application structure 117. Also, the vacuum hermetic sealing is performed within the passing-through hole of the through hole structure 108, so that it becomes possible to eliminate a protrusion from the back of the display panel 113.

By using the through hole structure 108, it becomes possible to substantially evenly maintain a potential from the vacuum side to the atmosphere side of the frit 104*a*, which makes it possible to prevent void discharge, dielectric breakdown, and the like. As a result, it becomes possible to improve vacuum hermetic reliability.

(3) Potential Regulating Structure

The low-voltage layer 114 (conductive layer) is a circular layer formed on the rear plate 102 such that a certain distance is maintained from the atmosphere side of the through hole structure 108. The low-voltage layer (conductive layer) 114 is electrically connected to the ground on the enclosure 115 side and is regulated to have the ground potential.

The voltage withstand structure 116 is formed between the through hole structure 108 and the low-voltage layer 114. The voltage withstand structure 116 is constructed from an insulating member coated with an insulating material having high volume resistivity or a high-resistance film. For instance, the insulating member is an antistatic film, a potting structure using an insulating material, or the like. Note that the center axis of the voltage withstand structure 116 substantially coincides with the center axes of the elastic structure 107 and the through hole structure 108. Power is supplied to the voltage application structure 117 from an unillustrated voltage power supply through a voltage cable.

The potential regulating structure is a structure where the low-voltage layer 114 is arranged around the through hole structure 108 to which a voltage is applied and the voltage withstand structure 116 is placed between the through hole structure 108 and the low-voltage layer 114. With this structure, it becomes possible to confine the existing area of the high potential applied to the through hole structure within the inside of the low-voltage layer (conductive layer) (area between the low-voltage layer (conductive layer) and the through hole), which makes it possible to prevent accidental discharge from occurring on the periphery of the rear plate atmosphere side. It also becomes possible to suppress the changing of an electric field around the through hole structure 108 due to environmental variations. By adopting a potential regulating structure like this, it becomes possible to apply a voltage with stability and to drive the display panel 113 with stability.

Also, the display apparatus is produced by sealing the display panel 113, an unillustrated voltage power supply, a voltage cable, a drive circuit substrate, a low-voltage power supply, and the like, in the enclosure 115.

It should be noted here that as described above, in this embodiment, the elastic structure 107, the through hole structure 108 formed on the rear plate 102, and the voltage withstand structure 116 on the atmosphere side are adopted for the voltage application structure 117 for applying voltage to the anode electrode 106 and respective center axes are set so as to substantially coincide with each other. This means that the potential distribution from the center axis of the voltage application structure 117 also becomes substantially axially symmetrical. Consequently, the structure of the present invention is particularly preferable because it becomes possible to reduce the distortion of a potential that becomes a cause of discharging. As a result, it becomes possible to obtain the voltage application structure 117 and the display apparatus 113 in which a potential is stabilized. Also, the vacuum hermetic sealing is performed within the passing-through hole of the through hole 108, so that it becomes possible to eliminate a protrusion from the back of the display apparatus 113. As a result, it becomes possible to reduce the size and thickness of the display apparatus 113 and also to perform stable image display with high conduction reliability.

Also, it is possible to perform the vacuum sealing for sealing the hole of the rear plate 102, in which the through hole structure 108 has been formed, and the positioning of the elastic structure 107 using the same member that is the frit 104*a* in the same step, so that it becomes possible to realize the display apparatus 113 having a low cost structure.

(Second Embodiment)

Figure 6:
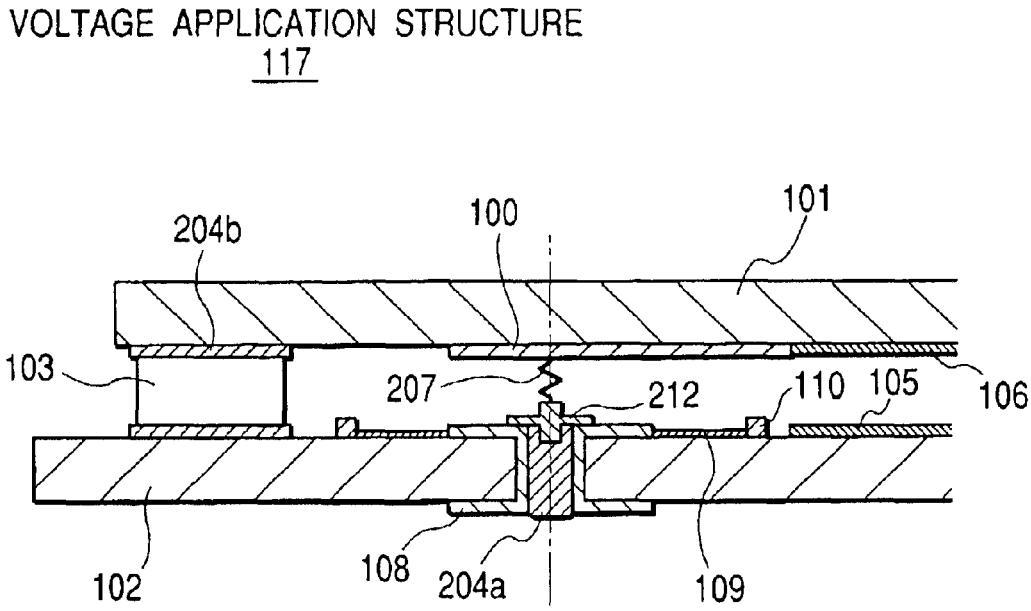
FIG. 6 is an assembled sectional view showing the voltage application structure of the present invention and a second embodiment of the display apparatus using this voltage application structure.

FIG. 6 is a disassembled perspective view of the second embodiment of the voltage application structure of the present invention and a display apparatus using this voltage application structure. Note that, a disassembled perspective view of the voltage application structure of the present invention and a display apparatus using this voltage application structure is the same as the one in FIG. 1A in the first embodiment. Also, a schematic view of the voltage application structure of the present invention and a display apparatus using this voltage application structure is the same as the one in FIG. 4 in the first embodiment.

Accordingly, there will be described in detail the elastic structure 207 that is a feature differenct from the first embodiment. Note that as to the reference numerals in FIG. 6, the same reference numerals are given to the same construction elements in FIG. 1. Also, other construction elements that are similar to those in FIG. 1 will be described using reference numerals starting from 200.

(2) Elastic Structure

The elastic structure 207 is placed between the through hole structure 108 on the rear plate 102 and the face plate 101. Note that the elastic structure 207 is constructed so as to be substantially axially symmetrical about a center axis and the center axis of the elastic structure 207 substantially coincide with the center axis of the through hole structure 108. Also, on the face plate 101, there is provided the lead wiring 100 from the anode electrode 106 described above to a portion contacting the elastic structure 207.

For the elastic structure 207, there is adopted a compression spring structure, whose line diameter is $\phi$0.2 mm, and a piano wire (SWP) is adopted for the material of the compression spring.

The elastic structure 207 is placed on the vacuum side of the through hole structure 108 that is a surface of the rear plate 102 opposing the face plate 101 before the face plate 101 and the rear plate 102 are sealed.

As a method of placing the elastic structure 207, there is used a method with which in a step for sealing the passing-through hole (not shown) of the rear plate 102 with the frit 204*a*, the positioning member 212 is inserted into the hole of the rear plate 102 after applying the frit 204*a* thereto, drying is performed in a drying furnace (at 120 degrees centigrade for 10 minutes), baking is performed in a baking furnace (at 390 degrees centigrade for 10 minutes), and thereafter the elastic structure 207 is placed.

By using the positioning member 212 for the positioning of the elastic structure 207 in this manner, it becomes easy to perform the positioning and to shorten a process time. Note that the 426 alloy is adopted as the material of the positioning member 212.

There is used the elastic structure 207 in order to establish electrical conduction between the lead wiring 100 on the face plate 101 side and the through hole structure 108 on the rear plate 102 side. With this construction, it becomes possible to prevent contacting failures due to minute deformations, a poor degree of parallelization, and the like resulting from the thermal changing between the face plate 101 and the rear plate 102.

An area occupied by the elastic structure 207 (whose diameter is around 5 mm) on the rear plate 102 is set as smaller than an area occupied by the electrode (first conductor) provided on the vacuum side of the rear plate constituting the through hole structure 108 (whose diameter is around 6 mm) and an area occupied by the lead wiring 100 (second conductor) of the face plate. With this structure, it becomes possible to place the elastic structure 207 so as not to lie off the lead wiring 100 on the face plate 101 side and the through hole structure 108 on the rear plate 102 side (the elastic structure 207 is contained within an area in which the orthographic projection area of the first conductor to the face plate overlaps the orthographic projection area of the second conductor to the rear plate). As a result, the potential distribution in the vicinity of the elastic structure 207 changes from the potential distribution caused by the potential difference between the elastic structure 207 and the low-voltage wiring 110 to the potential distribution caused by the potential distribution between the through hole structure 108 and the low-voltage wiring 110, which makes it possible to suppress the occurrence of discharging due to the protruding portion resulting from the shape of the elastic structure 207, the roughness of finishing, or the like without depending on the shape of the elastic structure 207. Also, it is possible to seal a vacuum structure only by sealing the passing-through hole of the through hole structure 108, so that it becomes possible to reduce the number of sealed portions. As a result, it becomes possible to improve the hermetic reliability of the voltage application structure 117. Also, the vacuum hermetic sealing is performed within the passing-through hole of the through hole structure 108, so that it becomes possible to eliminate a protrusion from the back of the display panel 113.

By using the through hole structure 108, it becomes possible to substantially evenly maintain a potential from the vacuum side to the atmosphere side of the frit 204*a*, which makes it possible to prevent void discharge, dielectric breakdown, and the like. As a result, it becomes possible to improve vacuum hermetic reliability.

(3) Potential Regulating Structure

The low-voltage layer 114 is a circular layer formed on the rear plate 102 so that a certain distance is maintained from the atmosphere side of the through hole structure 108. The low-voltage layer 114 is electrically connected to the ground on the enclosure 115 side and is regulated to have the ground potential.

The voltage withstand structure 116 is formed between the through hole structure 108 and the low-voltage layer 114. The voltage withstand structure 116 is constructed from an insulating member coated with an insulating material having high volume resistivity or a high-resistance film. For instance, the insulating member is an antistatic film, a potting structure using an insulating material, or the like. Note that the center axis of the voltage withstand structure 116 substantially coincide with the center axes of the elastic structure 207 and the through hole structure 108. Power is supplied to the voltage application structure 117 from an unillustrated voltage power supply through a voltage cable.

The potential regulating structure is a structure where the low-voltage layer 114 is arranged around the through hole structure 108 to which a voltage is applied and the voltage withstand structure 116 is placed between the through hole structure 108 and the low-voltage layer 114. With this structure, it becomes possible to confine the existing area of the high potential applied to the through hole structure within the inside of the low-voltage layer (conductive layer) (area between the low-voltage layer (conductive layer) and the through hole), which makes it possible to prevent accident discharge from occurring on the periphery of the rear plate atmosphere side. It also becomes possible to suppress the changing of an electric field around the through hole structure 108 due to environmental variations. By adopting a potential regulating structure like this, it becomes possible to apply a voltage with stability and to drive the display panel 113 with stability.

Also, the display apparatus is produced by sealing the display panel 113, an unillustrated voltage power supply, a voltage cable, a drive circuit substrate, a low-voltage power supply, and the like in the enclosure 115.

It should be noted here that as described above, in this embodiment, the elastic structure 207, the through hole structure 108 formed on the rear plate 102, and the voltage withstand structure 116 on the atmosphere side are adopted for the voltage application structure 117 for applying voltage to the anode electrode 106 and respective center axes are set so as to substantially coincide with each other. This means that the potential distribution from the center axis of the voltage application structure 117 also becomes substantially axially symmetrical. Consequently, the structure of the present invention is particularly preferable because it becomes possible to reduce the distortion of a potential that becomes a cause of discharging. As a result, it becomes possible to obtain the voltage application structure 117 and the display apparatus 113 in which a potential is stabilized. Also, the vacuum hermetic sealing is performed within the passing-through hole of the through hole 108, so that it becomes possible to eliminate a protrusion from the back of the display apparatus 113. As a result, it becomes possible to reduce the size and thickness of the display apparatus and also to perform stabilized image displaying with high conduction reliability.

Also, the positioning of the elastic structure 207 is performed using the positioning member 212, so that it becomes possible to easily place the elastic structure 207. As a result, it becomes possible to realize a low cost structure with which it is possible to produce the display apparatus by a simple process.

(Third Embodiment)

Figure 7:
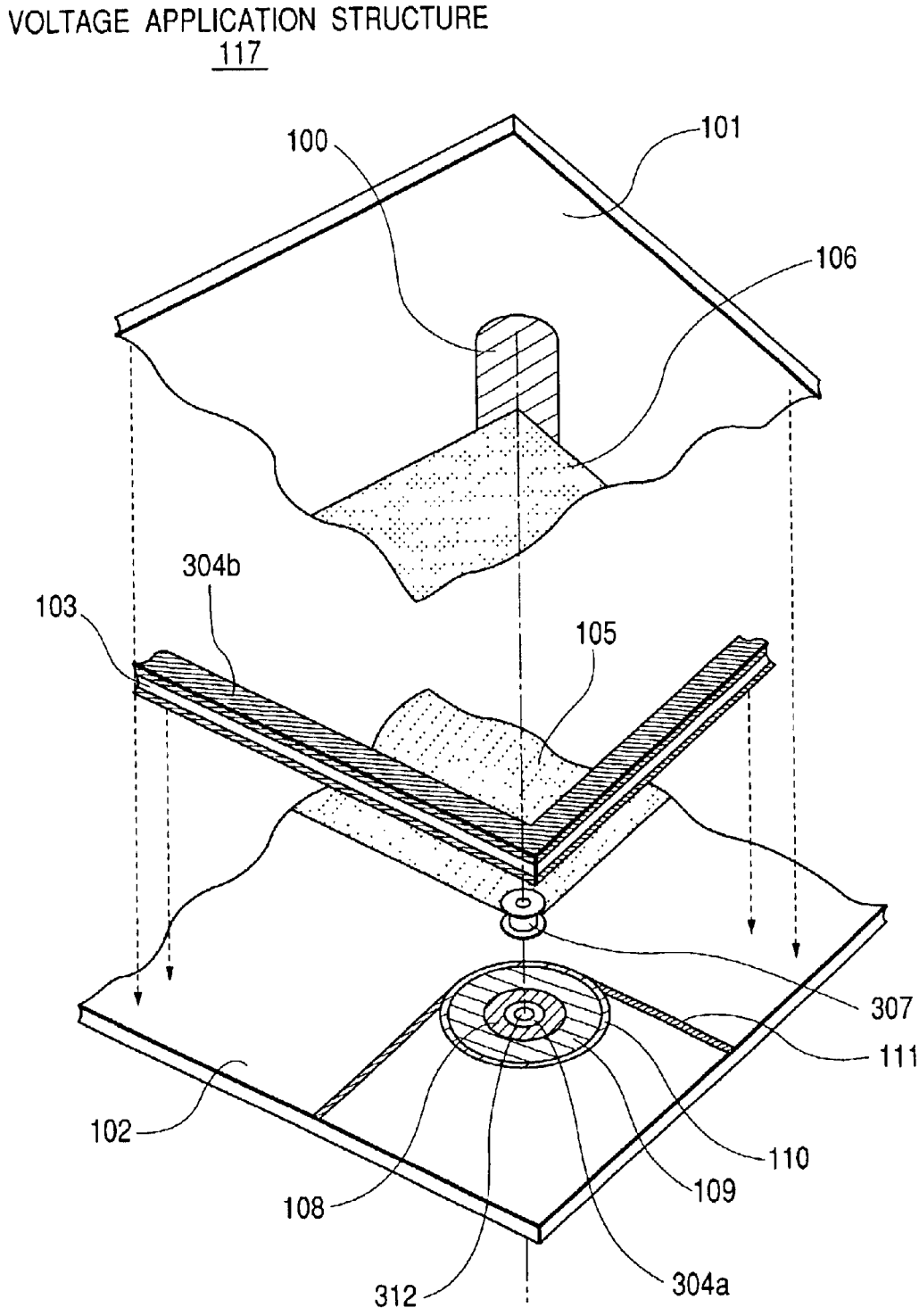
FIG. 7 is a disassembled sectional view showing the voltage application structure of the present invention and a third embodiment of the display apparatus using this voltage application structure.
Figure 8:
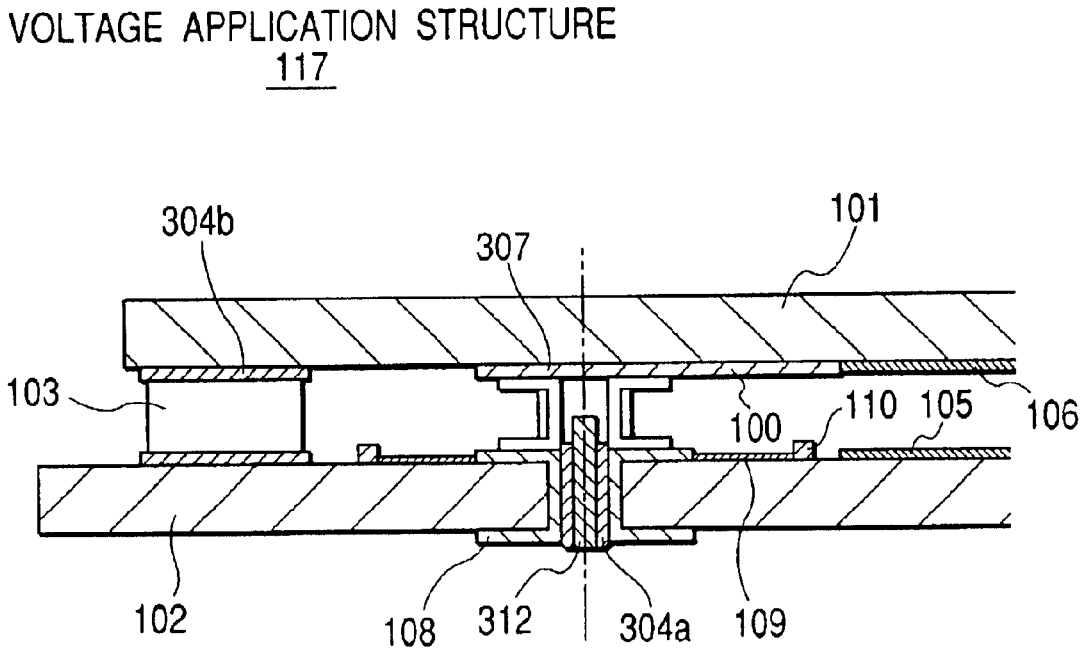
FIG. 8 is an assembled sectional view showing the voltage application structure of the present invention and the third embodiment of the display apparatus using this voltage application structure.

FIG. 7 is a disassembled perspective view of the third embodiment of the voltage application structure of the present invention and a display apparatus using this voltage application structure. Also, FIG. 8 is an assembled sectional view of the voltage application structure of the present invention and the display apparatus using this voltage application structure. Note that, a schematic view of the voltage application structure of the present invention and a display apparatus using this voltage application structure is the same as the one in FIG. 4 in the first and the second embodiments.

Accordingly, the elastic structure will be described below, which is a feature different between the preceding embodiments and this embodiment. The elastic structure 307 is placed between the through hole structure 108 on the rear plate 102 and the face plate 101. Note that the elastic structure 307 is constructed so as to be substantially axially symmetrical about a center axis and the center axis of the elastic structure 307 substantially coincide with the center axis of the through hole structure 108. Also, on the face plate 101, there is provided the lead wiring 100 from the anode electrode 106 described above to a portion contacting the elastic structure 307.

Here, the outline of the elastic structure 307 will be described with reference to FIGS. 3A and 3B. Note that the elastic structure 307 is placed so that the surface illustrated upwardly in FIGS. 3A and 3B is directed toward the face plate 101.

Elastic portions 121 are grounded to the upper surface and the lower surface of the seating 122 by laser spot welding or the like, such that the center axes of respective outline circles coincide with each other. Also, to circumferential edges of the surfaces of the elastic portions 121 that are not grounded to the seating 122, there are grounded fulcrums 120*a* and 120*b* by laser spot welding or the like so that the center axes thereof coincide with each other in the like manner.

The elastic structure 307 is designed so that a surface of the fulcrum 120*a* that is not grounded to the elastic portion 121 is brought into intimate contact with the lead wiring 100 on the face plate 101 and a surface of the fulcrum 120*b* that is not grounded to the elastic portion 121 is brought into intimate contact with the through hole 108 on the rear plate 102.

The elastic structure 307 is placed on the vacuum side of the through hole structure 108 that is a surface of the rear plate 102 opposing the face plate 101 before the face plate 101 and the rear plate 102 are sealed.

As a method of placing the elastic structure 307, there is used a method with which in a step for sealing the passing-through hole (not shown) of the rear plate with the frit 304*a*, the positioning member 312 is inserted into the hole of the rear plate 102 after applying the frit 304*a* thereof, drying is performed in a drying furnace (at 120 degrees centigrade for 10 minutes), baking is performed in a baking furnace (at 390 degrees centigrade for 10 minutes), and thereafter the elastic structure 307 is placed.

By using the positioning member 312 for the positioning of the elastic structure 307 in this manner, it becomes easy to perform the positioning of the elastic structure 307 and to shorten a process time. Also, after the baking of the frit 304*a*, the elastic structure 307 is merely placed on the rear plate 102, so that the elastic structure 307 is not bonded to the rear plate 102. Accordingly, there is saved the trouble of pressing and placing the elastic structure 307 during the baking of the frit 304*a*, which makes it possible to simplify a production process. Also, there are prevented problems such as inclined placement of the elastic structure 307, an occurrence of a crack in the rear plate 102 due to the pressing, and the like.

A plate spring structure is adopted for the elastic structure 307 and the main material thereof is the 426 alloy. Also, the positioning member 312 is made of the 426 alloy and has a cylindrical shape whose diameter is 1.5 mm and whose height is 3 mm. By constructing the rear plate 102 and the positioning member 312 using materials having similar coefficients of thermal expansion in this manner, it becomes possible to obtain the voltage application structure 117 in which thermal stress due to thermal changing does not occur and peeling or the like at the bonding interface does not occur.

There is used the elastic structure 307 in order to establish electrical continuity between the lead wiring 100 on the face plate 101 side and the through hole structure 108 on the rear plate 102 side. With this construction, it becomes possible to prevent contacting failures due to minute deformations, the poor degree of parallelization, and the like due to the thermal changing between the face plate 101 and the rear plate 102.

It is preferable that the elastic portion 121 is constructed from a plurality of springs whose number is at least equal to three. In this embodiment, three springs are arranged in parallel. With this construction, even in the case where a small protrusion or scratch exists on a surface contacting the fulcrums 120*a* and 120*b* of the face plate 101 and the rear plate 102, it becomes possible to have the fulcrums 120*a* and 120*b* contact the face plate 101 and the rear plate 102 with reliability.

An area occupied by the elastic structure 307 on the rear plate 101 is set as smaller than an area occupied by the electrode (first conductor) provided on the vacuum side of the rear plate constituting the through hole structure 108 and an area occupied by the lead wiring 100 (second conductor) of the face plate. With this structure, it becomes possible to place the elastic structure 307 so as not to lie off the lead wiring 100 on the face plate 101 side and the through hole structure 108 on the rear plate 102 side (the elastic structure 307 is contained within an area in which the orthographic projection area of the first conductor to the face plate overlaps the orthographic projection area of the second conductor to the rear plate). As a result, the potential distribution in the vicinity of the elastic structure 307 changes from the potential distribution caused by the potential difference between the elastic structure 307 and the low-voltage wiring 110 to the potential distribution caused by the potential distribution between the through hole structure 108 and the low-voltage wiring 110, which makes it possible to suppress an occurrence of discharge due to the protruding portion resulting from the shape of the elastic structure 107, roughness of finishing, or the like, without depending on the shape of the elastic structure. Also, it is possible to seal a vacuum structure only by sealing the passing-through hole of the through hole structure 108, so that it becomes possible to reduce the number of sealed portions. As a result, it becomes possible to improve the hermetic reliability of the voltage application structure 117. Also, the vacuum hermetic sealing is performed within the passing-through hole of the through hole structure 108, so that it becomes possible to eliminate a protrusion from the back of the display panel 113.

By using the through hole structure 108, it becomes possible to substantially evenly maintain a potential from the vacuum side to the atmosphere side of the frit 304*a*, which makes it possible to prevent void discharge, dielectric breakdown, and the like. As a result, it becomes possible to improve vacuum hermetic reliability. Also, as in the first embodiment, a potential regulating structure is provided to the rear surface on the atmosphere side.

The potential regulating structure is provided in the like manner as in the first embodiment, so that it becomes possible to confine the existing area of the high potential applied to the through hole structure within the inside of the low-voltage layer (conductive layer) (area between the low-voltage layer (conductive layer) and the through hole), which makes it possible to prevent accidental discharge from occurring on the periphery of the rear plate atmosphere side. It also becomes possible to suppress the changing of an electric field around the through hole structure 108 due to environmental variations. By adopting a potential regulating structure like this, it becomes possible to apply a voltage with stability and to drive the display panel 113 with stability.

Also, the display apparatus is produced by sealing the display panel 113, an unillustrated voltage power supply, a voltage cable, a drive circuit substrate, a low-voltage power supply, and the like, in the enclosure 115.

As described above, in this embodiment, the elastic structure 307, the through hole structure 108 formed on the rear plate 102, and the voltage withstand structure 116 on the atmosphere side are adopted for the voltage application structure 117 to the anode electrode 106 and respective center axes are set so as to substantially coincide with each other. This means that the potential distribution from the center axis of the voltage application structure 117 also becomes substantially axially symmetrical. Consequently, it becomes possible to reduce the distortion of a potential that becomes a cause of discharging. As a result, it becomes possible to obtain the voltage application structure 117 and the display apparatus in which a potential is stabilized. Also, the vacuum hermetic sealing is performed within the passing-through hole of the through hole 108, so that it becomes possible to eliminate a protrusion from the back of the display panel 113. As a result, it becomes possible to reduce the size and thickness of the display apparatus and also to perform stabilized image displaying with high conduction reliability.

Also, the positioning of the elastic structure 307 is performed using the positioning member 312, so that it becomes possible to easily place the elastic structure 307. As a result, it becomes possible to realize a low cost structure with which it is possible to produce the display apparatus by a simple process.

Also, electrical continuity is maintained without bonding the elastic structure 307 to the rear plate 102 with the frit 304*a*, so that it becomes possible to prevent electrical conduction failures or the like due to the peeling of a bonding surface or bonding failures.

(Fourth Embodiment)

Figure 9:
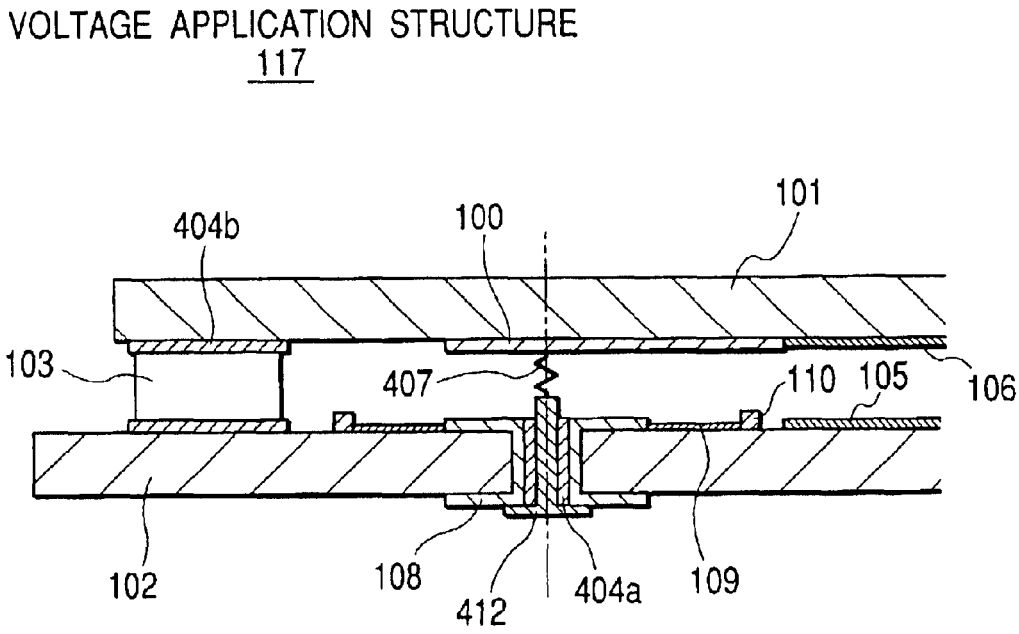
FIG. 9 is an assembled sectional view showing the voltage application structure of the present invention and a fourth embodiment of the display apparatus using this voltage application structure.

FIG. 9 is an assembled sectional view of the fourth embodiment of the voltage application structure of the present invention and a display apparatus using this voltage application structure. Note that, the disassembled perspective view of the voltage application structure of the present embodiment and a display apparatus using this voltage application structure, apart from the shape of the elastic structure, is the same as the one in FIG. 7 in the third embodiment. Also, a schematic view of the voltage application structure of the present invention and a display apparatus using this voltage application structure, is the same as the one in FIG. 4 in the first to the third embodiments.

Accordingly, the elastic structure will be described below, which is a feature different from the preceding embodiments. The elastic structure 407 is placed between the through hole structure 108 on the rear plate 102 and the face plate 101. Note that the elastic structure 407 is constructed so as to be substantially axially symmetrical about a center axis and the center axis of the elastic structure 407 substantially coincide with the center axis of the through hole structure 108. Also, on the face plate 101, there is provided the lead wiring 100 from the anode electrode 106 described above to a portion contacting the elastic structure 407.

The elastic structure 407 is placed on the vacuum side of the through hole structure 108 that is a surface of the rear plate 102 opposing the face plate 101 before the face plate 101 and the rear plate 102 are sealed.

As a method of placing the elastic structure 407, there is used a method with which in a step for sealing the passing-through hole (not shown) of the rear plate with the frit 404*a*, a positioning member 412 is inserted into the hole of the rear plate 102 and the frit 404*a* is applied in the gap therebetween, drying is performed in a drying furnace (at 120 degrees centigrade for 10 minutes), baking is performed in a baking furnace (at 390 degrees centigrade for 10 minutes), and thereafter the elastic structure 407 is placed.

By using the positioning member 412 for the positioning of the elastic structure 407 in this manner, it becomes easy to perform the positioning of the elastic structure 407 and to shorten a process time. Also, after the baking of the frit 404*a*, the elastic structure 407 is merely placed on the rear plate 102 and therefore the elastic structure 407 is not bonded to the rear plate 102. Accordingly, there is saved the trouble of pressing and bonding the elastic structure 407 against and to the rear plate 102, which makes it possible to simplify a production process. Also, it becomes unnecessary to perform the pressing and bonding of the elastic structure 407 during the baking of the frit 404*a*, so that it becomes possible to prevent problems such as inclined bonding of the elastic structure 407, an occurrence of a crack in the rear plate 102 due to the pressing, and the like.

For the elastic structure 407, there is adopted a compression spring structure whose line diameter is Φ0.2 mm and SUS304 (stain less 304) is adopted for the material of the compression spring. Also, the positioning member 412 is made of the 48 Ni alloy and has a shape where a cylinder, whose diameter is 1.5 mm and height is 3 mm, is integrated with a disc whose diameter is 3 mm and thickness is 0.5 mm, with the disc being connected to one end of the cylinder. This disc portion contacts the rear plate and seals the opening, which means that the disc portion also serves as a structure for sealing the display panel. Also, on a side opposite to the disc of this positioning member 412, there is grounded the elastic structure 407 by laser spot welding or the like.

There is used the elastic structure 407 in order to establish electrical continuity between the lead wiring 100 on the face plate 101 side and the through hole structure 108 on the rear plate 102 side. With this construction, it becomes possible to prevent contacting failures due to minute deformations, the poor degree of parallelization, and the like due to the thermal changing between the face plate 101 and the rear plate 102.

An area occupied by the elastic structure 407 on the rear plate 101 is set as smaller than an area occupied by the electrode (first conductor) provided on the vacuum side of the rear plate constituting the through hole structure 108 and an area occupied by the lead wiring 100 (second conductor) of the face plate. With this structure, it becomes possible to place the elastic structure 407 so as not to lie off the lead wiring 100 on the face plate 101 side and the through hole structure 108 on the rear plate 102 side (the elastic structure 407 is contained within an area in which the orthographic projection area of the first conductor to the face plate overlaps the orthographic projection area of the second conductor to the rear plate). As a result, the potential distribution in the vicinity of the elastic structure 407 changes from the potential distribution caused by the potential difference between the elastic structure 407 and the low-voltage wiring 110 to the potential distribution caused by the potential distribution between the through hole structure 108 and the low-voltage wiring 110, which makes it possible to suppress the occurrence of discharging due to the protruding portion resulting from the shape of the elastic structure 407, the roughness of finishing, or the like, without depending on the shape of the elastic structure 407. Also, it is possible to seal a vacuum structure only by sealing the passing-through hole of the through hole structure 108, so that it becomes possible to reduce the number of sealed portions. As a result, it becomes possible to improve the hermetic reliability of the voltage application structure 117. Also, the vacuum hermeticity is performed within the passing-through hole and the disc portion of the through hole structure 108, so that it becomes possible to eliminate a protrusion from the back of the display apparatus 113.

A surface of the positioning member 412 on a side opposite to the electron source area 105 of the rear plate 102 has a disc-like shape, so that there is obtained superior stability during the placement before the baking of the frit 404*a* and there is obtained improved perpendicularity of the positioning member 412 with reference to the rear plate 102. As a result, as to the perpendicularity of the positioning member 412 with reference to the rear plate 102 after the baking, the inclination between the top and bottom of the positioning member 412 is reduced from 0.2 mm at the maximum to 0.1 mm or below, so that it becomes possible to perform favorable positioning thereof with reference to the elastic structure 407. Also, the positioning member 412 and the elastic member 407 that are each made of a metal are bonded to each other, which improves the reliability concerning the electrical continuity to the lead wiring 100. Also, as to the electrical continuity between the positioning member 412 and the through hole structure 108, it is possible to repair the electrical continuity by soldering or the like with reliability, after the production of the display panel 113, which improves the reliability concerning the electrical continuity of the whole of the voltage application structure 117. Further, a disc portion is provided for the positioning member 412, so that it becomes possible to significantly improve the positional accuracy of the positioning member 412 with reference to the rear plate 102 in an axial direction. As a result, it becomes possible to reduce variations of the height of the elastic member 407 from 0.2 mm to 0.1 mm or below.

By using the through hole structure 108, it becomes possible to approximately evenly maintain a potential from the vacuum side to the atmosphere side of the frit 404*a*, which makes it possible to prevent void discharge, dielectric breakdown, and the like. As a result, it becomes possible to improve vacuum hermetic reliability.

Also in this embodiment, a potential regulating structure is provided to the rear plate surface of the air ride, as in the other embodiments.

The potential regulating structure is provided, so that it becomes possible to confine the existing area of the high potential applied to the through hole structure within the inside of the low-voltage layer (conductive layer) (area between the low-voltage layer (conductive layer) and the through hole), which makes it possible to prevent accidental discharging on the periphery of the rear plate atmosphere side. It also becomes possible to suppress the changing of an electric field around the through hole structure 108 due to environmental variations. By adopting a potential regulating structure like this, it becomes possible to apply a voltage with stability and to drive the display panel 113 with stability.

Also, the display apparatus is produced by sealing the display panel 113, an unillustrated voltage power supply, a voltage cable, a drive circuit substrate, a low-voltage power supply, and the like, in the enclosure 115.

Also, as in the other embodiments, the elastic structure 407, the through hole structure 108 formed on the rear plate 102, and the withstand voltage structure 116 on the atmosphere side are adopted for the voltage application structure 117 to the anode electrode 106, and respective center axes are set so as to approximately coincide with each other. This means that the potential distribution from the center axis of the voltage application structure 117 also becomes approximately axial symmetry. Consequently, it becomes possible to reduce the distortion of a potential that becomes a cause of discharging. As a result, it becomes possible to obtain the voltage application structure 117 and the display apparatus in which a potential is stabilized. Also, the vacuum hermeticity is performed within the passing-through hole of the through hole 108, so that it becomes possible to eliminate a protrusion from the back of the display panel 113. As a result, it becomes possible to reduce the size and thickness of the display apparatus and also to perform stabilized image displaying with continuity reliability.

Also, on the lower side of the positioning member 412, there is formed a step (disc portion) so that the hole of the rear plate 102 is closed. As a result, it becomes possible to improve the positional accuracy of the positioning member 412 in a thickness direction of the rear plate 102 and to obtain elasticity of the elastic structure 407 with no individual differences.

Also, the electric conduction between the through hole structure 108 and the lead wiring 100 is performed on the atmosphere side of the rear plate 102 through the elastic structure 407 and the positioning member 412, so that in the case where there occurs an electrical conduction failure between the through hole structure 108 and the lead wiring 100, it is possible to maintain the electrical conduction by a repair even after the display panel 113 is produced. As a result, it becomes possible to improve yields.

As described above, with the technique of the present invention, the conductive elastic structure for supplying power to the anode electrode is contained within an area in which the orthographic projection of an conductor (first conductor) provided on the vacuum surface of the rear plate to the face plate overlaps the orthographic projection of an conductor (second conductor), such as the anode electrode or the lead electrode portion for supplying power to the anode electrode, to the rear plate. With this construction, the potential distribution on the periphery of the elastic structure body does not depend on the shape of the elastic structure body but is regulated by the first conductor and the second conductor. As a result, it becomes possible to prevent accidental discharge from occurring due to the shape (projection or the like) of the elastic structure body or positional relations.

Also, a low potential such as the ground potential is applied to a conductive layer provided on the air surface of the rear plate, so that even in the case of a structure where a conductive member provided for anode power supply is led to the outside through a hole provided in the rear plate, it becomes possible to confine the existing area of the high potential applied to the conductive member for anode power supply, within the inside of the low-voltage layer (conductive layer) (area between the low-voltage layer (conductive layer) and the conductive member for anode power supply), which makes it possible to prevent accidental discharge from occurring on the periphery of the rear plate atmosphere side. Also, the through hole structure and the elastic structure are adopted for the voltage application structure for applying voltage to the anode electrode, and their respective center axes are set so as to substantially coincide with each other, so that it becomes possible to eliminate a protrusion from the back of the display apparatus and to reduce its size, thickness, and cost. In addition, it becomes possible to obtain such superior effects that high hermetic reliability is realized and stable image display is performed.

What is claimed is:

1. A display apparatus comprising:

a vacuum container that includes at least a first substrate and a second substrate, the first substrate having on a same surface an electron source and a first conductor that is regulated to have a higher potential than the electron source, and the second substrate having on a surface thereof an image forming member that has a second conductor regulated to have approximately a same potential as the first conductor, with the surface having the image forming member being arranged so as to oppose the surface of the first substrate having the electron source; and a conductive elastic structure made at least partially of an elastic body, which exists inside of the vacuum container and contacts the first conductor and the second conductor so as to electrically connect the first conductor to the second conductor, wherein the conductive elastic structure is disposed inside of an area in which the first and second conductors are formed.

2. A display apparatus according to claim 1, wherein the first substrate has a through hole terminal connected to the inside of the vacuum container and the potential of the first conductor is regulated through the through hole terminal.

3. A display apparatus according to claim 2, wherein the first substrate has low-voltage wiring that is arranged around the first conductor and is regulated to have a lower potential than the first conductor.

4. A display apparatus according to claim 3, further comprising a high-resistance film between the first conductor and the low-voltage wiring.

5. A display apparatus according to claim 2, wherein each of the first conductor and the conductive elastic structure is axially symmetrical about a center axis, and the respective center axes of the first conductor and the conductive elastic structure substantially coincide with each other.

6. A display apparatus according to claim 2, further comprising means for sealing the vacuum container, and also serving as means for positioning the conductive elastic structure.

7. A display apparatus according to claim 1, wherein the conductive elastic structure has an elastic portion including a plurality of springs whose number is at least equal to three.

8. A display apparatus comprising:

a vacuum container that includes at least a first substrate having an electron source on a surface thereof and a second substrate having on a surface thereof an image forming member arranged such that the surface having the image forming member opposes the surface of the first substrate having the electron source, the image forming member having an anode electrode that is regulated to have a higher potential than the electron source; and a conductive member which exists inside of the vacuum container, is electrically connected to the anode electrode, and is led to the outside of the vacuum container through a hole established in the first substrate, wherein a conductive layer is provided around the hole on a surface of the first substrate on a side opposite to an inner surface of the vacuum container, and wherein the conductive layer is regulated to have a lower potential than the anode electrode, and wherein the display apparatus further comprises a voltage withstand structure between the conductive member and the conductive layer.

9. A display apparatus according to claim 8, wherein the voltage withstand structure is constructed from an insulating material.

10. A display apparatus according to claim 8, wherein the voltage withstand structure is constructed from a high-resistance film.

11. A display apparatus according to claims 8, 9 or 10, further comprising a circuit for driving the display apparatus in the vicinity of the first substrate at the outside of the vacuum container.

* * * * *